United States Patent [19]

Hama et al.

[11] Patent Number: 4,729,984

[45] Date of Patent: Mar. 8, 1988

[54] HEAT SENSITIVE RECORDING SHEETS CONTAINING SULFONE DERIVATIVES

[75] Inventors: Fumio Hama, Osaka; Masayuki Omatsu, Hyogo; Mitsuru Kondo, Tokyo, all of Japan

[73] Assignee: Kanzaki Paper Manufacturing Co., Ltd., Tokyo, Japan

[21] Appl. No.: 894,498

[22] Filed: Aug. 4, 1986

[30] Foreign Application Priority Data

Aug. 9, 1985 [JP] Japan ..... 60-176319

[51] Int. Cl.[4] ..... B41M 5/18

[52] U.S. Cl. ..... 503/216; 427/150; 427/151; 503/225

[58] Field of Search ..... 346/216, 217, 225; 427/150–152; 503/216, 217, 225

[56] References Cited

U.S. PATENT DOCUMENTS 4,608,580 8/1986 Ikeda et al. ..... 427/150
4,612,557 9/1986 Hama et al. ..... 427/150

FOREIGN PATENT DOCUMENTS 0036694 2/1982 Japan ..... 346/216
0219088 11/1985 Japan ..... 346/225

*Primary Examiner*—Bruce H. Hess
*Attorney, Agent, or Firm*—Browdy and Neimark

[57] ABSTRACT

An improved heat sensitive recording sheet having a wealth of high speed recording characteristics and remarkably improved resistances against plasticizers and against diazo developers which contain at least a 3,4-dihydroxydiphenyl sulfone derivative.

3 Claims, No Drawings

HEAT SENSITIVE RECORDING SHEETS CONTAINING SULFONE DERIVATIVES

FIELD OF THE INVENTION

The present invention relates to the improvement in a heat sensitive recording sheet. More particularly, it relates to an improved heat sensitive recording sheet containing 3,4-dihydroxydiphenyl sulfone derivative as an electron accepting color developing material, which has a wealth of a high speed recording suitability and a durability of the once developed color images and which does not invite any deterioration of whiteness on the remaining blank (background) parts.

BACKGROUND OF THE INVENTION

There are known various kinds of heat sensitive recording (copying) systems for transmitted information wherein a color forming reaction between a colorless or pale colored basic chromogenic material and an electron accepting organic or inorganic color developing material (hereinafter referred to as "acceptor") is utilized, and heat or electric energy serves as a medium to obtain expected color images.

Now, there has been made remarkable improvements in the speed of the recording functions of thermal type facsimiles and printers. In fact, it becomes possible to record a quantity of an A-4 size paper within 20 seconds for the thermal type facsimile and a quantity of 120 characters within a second for the printer.

Following such improvements in the thermal type facsimiles and the printers, there is an increased demand for a heat sensitive recording sheet to be such that can sufficiently fit with their high speed functions and of possessing a sufficient durability without discoloration of the once developed color images even in a long storage.

However, for known heat sensitive recording sheet, in addition to that it can not sufficiently satisfy said demand there still exist defects that the once developed color images thereon is sooner or later discolored on contact with a plastic film which is used to store it in a file or the remaining blank (background) parts of the sheet are significantly apt to be undesirably fogged during its storage in the state of being piled up together with a diazo type copying paper particularly soon after having been copied.

Therefore, there is an additional increased demand for a heat sensitive recording sheet to be such that is not accompanied with the above problems.

SUMMARY OF THE INVENTION

The present inventors have conducted extensive studies in order to solve the above-mentioned problems in the known heat sensitive recording sheets and in order to provide an improved heat sensitive recording sheet which meets the above-mentioned demands.

As a result, the present inventors firstly have found that the occurrence of the discoloration of the once developed color images and the generation of the fogs on the remaining blank parts for known heat sensitive recording sheet are respectively due to the mutual reaction of an acceptor contained in the sheet with a plasticizer contained in the plastic film and the mutual reaction between said acceptor and solvents contained in a developer of the diazo type copying paper.

Standing on these findings, the present inventors have continued further extensive studies chiefly aiming at elimination of the occurrences of those mutual reactions for known heat sensitive recording sheet in any case.

At the end, present inventors have found that when a compound represented by the following structural formula:

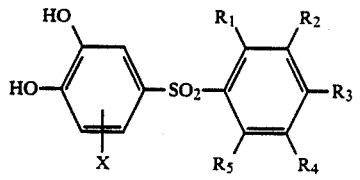

[I]

[wherein, X is a member selected from the group consisting of hydrogen atom, chlorine atom, bromine atom, alkyl group of 1 to 5 carbon atoms and alkoxy group of 1 to 5 carbon atoms, $R_1$, $R_2$, $R_3$, $R_4$ and $R_5$ are respectively a member selected from the group consisting of hydrogen atom, chlorine atom, bromine atom, hydroxyl group, alkyl group of 1 to 5 carbon atoms, cyclohexyl group, benzyl group, phenetyl group, phenyl group, alkoxyl group of 1 to 5 carbon atoms, benzyloxy group, phenoxy group, alkylthio group of 1 to 5 carbon atoms, benzylthio group, and phenylthio group, or either the combination of $R_1$ and $R_2$ or the combination of $R_2$ and $R_3$ may form a naphthalene ring, a tetrahydronaphthalene ring or an indane ring together with their adjacent benzene ring] is used as an acceptor in preparing a heat sensitive recording sheet, there may be obtained such an improved heat sensitive recording sheet that is well suited for high speed functions of the improved thermal type facsimiles and printers, invites neither any fog on the remaining blank (background) parts of the sheet nor any discoloration of the once developed color images on the sheet even in a long storage in touch with a diazo type copying paper or a plastic film and exhibits extremely improved resistances not only against plasticizers contained in the plastic films but also against solvents contained in a developer of the diazo type copying papers.

It is therefore an object of the present invention to provide an improved heat sensitive recording sheet having a wealth of image developing characteristics which appropriately fits with the high speed functions of the improved thermal type facsimiles and printers.

Another object of the present invention is to provide an improved heat sensitive recording sheet possessing improved resistances not only against a plasticizer contained in a plastic film to be used for storage of the recorded sheet but also against solvents contained in a developer of a diazo type copying paper.

A further object of the present invention is to provide an improved heat sensitive recording sheet possessing an excellent durability which is accompanied with neither occurrence of discoloration for the once developed color images nor generation of any fog for the remaining blank (background) parts even in a long storage.

DETAILED DESCRIPTION OF THE INVENTION

The improved heat sensitive recording sheet to be provided according to the present invention is of the type that a color forming reaction between a colorless or light color basic chromogenic material and an electron accepting organic or inorganic material capable of bringing about a coloration on contact with said chromogenic material is utilized, and heat or electric energy serves as a medium, and is characterized in that as the electron accepting color developing material at least a compound represented by the foregoing structural formula [I] is used.

Among these 3,4-dihydroxydiphenyl sulfone compounds, the compounds of the structural formula [I] wherein X is a member selected from the group consisting of hydrogen atom, chlorine atom, bromine atom, alkyl group of 1 to 5 carbon atoms and alkoxy group of 1 to 5 carbon atoms, each of $R_1$, $R_2$, $R_3$, $R_4$ and $R_5$ is a member selected from the group consisting of hydrogen atom, chlorine atom, bromine atom, hydroxyl group, alkyl group of 1 to 5 carbon atoms, cyclohexyl group, benzyl group, phenethyl group, phenyl group, alkoxyl group of 1 to 5 carbon atoms, benzyloxy group, phenoxy group, alkylthio group of 1 to 5 carbon atoms, benzylthio group and phenylthio group, or either the combination of $R_1$ and $R_2$ or the combination of $R_2$ and $R_3$ form a naphthalene ring, a tetrahydronaphthalene ring or an indane ring together with their adjacent benzene ring, are the most preferred, for the reasons that they are less expensive and give more desirable effects.

Examples of these most preferred compounds are, for example, 3,4-dihydroxydiphenyl sulfone, 3,4-dihydroxy-4'-methyldiphenyl sulfone, 3,4-dihydroxy-4'-ethyldiphenyl sulfone, 3,4-dihydroxy-4'-propyldiphenyl sulfone, 3,4-dihydroxy-4'-isopropyldiphenyl sulfone, 3,4-dihydroxy-4'-butyldiphenyl sulfone, 3,4-dihydroxy-2',4'-dimethyldiphenyl sulfone, 3,4-dihydroxy-4'-chlorodiphenyl sulfone, 3,4,4'-trihydroxydiphenyl sulfone, 3,4-dihydroxy-4'-cyclohexyldiphenyl sulfone, 3,4-dihydroxy-4'-methoxydiphenyl sulfone, 3,4-dihydroxy-4'-ethoxydiphenyl sulfone, 3,4-dihydroxy-4'-phenoxydiphenyl sulfone, 3,4-dihydroxy-4'-benzyloxydiphenyl sulfone, 3,4-dihydroxy-4'-benzyldiphenyl sulfone, 3,4-dihydroxy-4'-phenethyldiphenyl sulfone, 3,4-dihydroxy-4'-methylthiodiphenyl sulfone, 3,4-dihydroxy-4'-ethylthiodiphenyl sulfone, 3,4-dihydroxy-4'-phenylthiodiphenyl sulfone, 3,4-dihydroxy-4'-benzylthiodiphenyl sulfone, 3,4-dihydroxyphenyl 1-naphthyl sulfone, 3,4-dihydroxyphenyl 2-naphthyl sulfone, 3,4-dihydroxy-3',4'-trimethylenediphenyl sulfone, 3,4-dihydroxy-3',4'-tetramethylenediphenyl sulfone, 3,4-dihydroxy-6-chloro-4'-methyldiphenyl sulfone, 3,4-dihydroxy-6-methyl-4'-methyldiphenyl sulfone and 3,4-dihydroxy-5-methoxy-4'-methyldiphenyl sulfone.

The 3,4-dihydroxydiphenyl sulfone derivatives represented by the structural formula [I] to be used as an electron accepting color developing material (acceptor) in the present invention may be prepared representatively by the manners as hereunder shown:

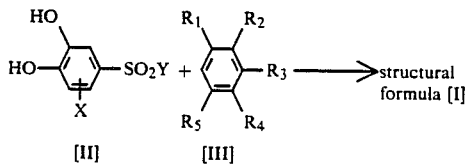

(1)

-continued

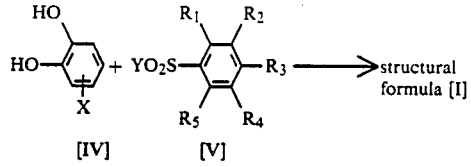

(2)

[wherein Y is halogen atom, $R_1$, $R_2$, $R_3$, $R_4$, $R_5$ and X are the same as defined before, respectively.]

In the above manner (1), a 3,4-dihydroxybenzenesulfonyl halide represented by the structural formula [II] is reacted with a benzene derivative represented by the structural formula [III] to obtain an objective 3,4-dihydroxydiphenyl sulfone derivative.

In the above manner (2), a catechol represented by the structural formula [IV] is reacted with an aromatic sulfonyl halide represented by the structural formula [V] to obtain an objective 3,4-dihydroxydiphenyl sulfone derivative.

And in either of the two manners, the condensation reaction is carried out at a temperature of 5° to 150° C. preferably in the presence of a condensing agent such as Friedel-Crafts type catalyst e.g. anhydrous tin chloride, anhydrous zinc chloride, anhydrous aluminum chloride, phosphorus trichloride, phosphorus tribromide, phosphorus pentachloride, boron trifluoride etc. alone or in combination.

As the solvent to be used in either of the two manners, carbon disulfide, monochlorobenzene, dichlorobenzene, dichloroethane, tetrachloroethane, nitrobenzene, nitromethane, nitroethane, or a mixture of two or more these solvents are preferably used.

The 3,4-dihydroxydiphenyl sulfone derivatives represented by the structural formula [I] may be prepared also in accordance with either of the following two manners.

According to one manner, a compound represented by the structural formula:

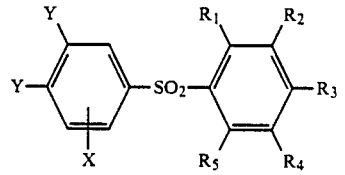

[VI]

[wherein, $R_1$, $R_2$, $R_3$, $R_4$, $R_5$, X and Y are the same as defined before, respectively.] is dissolved in an aqueous solution of sodium hydroxide and/or potassium hydroxide followed by heat treatment at a temperature of 200° to 250° C. to obtain an objective 3,4-dihydroxydiphenyl sulfone derivative.

According to the other manner, a compound represented by the structural formula:

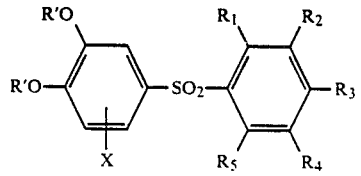

[VII]

[wherein, R' is lower alkyl group, $R_1$, $R_2$, $R_3$, $R_4$, $R_5$ and X are the same as defined before, respectively.] is contacted with a catalyst for dealkylation such as aluminum chloride, aluminum bromide, boron tribromide, hydrogen bromide, hydrogen iodide, trimethyl silyl iodide, pyridine hydrochloride, lithium iodide, etc. alone or in combination to obtain an objective 3,4-dihydroxydiphenyl sulfone derivative.

A colorless or pale colored basic chromogenic material (color former) is usually used together with a 3,4-dihydroxydiphenyl sulfone derivative of the structural formula [I] for the preparation of a desirable heat sensitive recording sheet according to the present invention.

As the color former, there can be used any known colorless or pale colored basic chromogenic materials either alone or as a mixture of two or more as long as they develop a hue of substantially deep color upon contact with the acceptor.

In any case, the color former to be used is selected appropriately in accordance with the kind of a heat sensitive recording sheet desired.

Examples of useful colorless or pale-colored basic chromogenic materials as the color former are those already known and include:

Triarylmethane-based chromogenic materials, e.g. 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-2-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based chromogenic materials, e.g., 4,4'-bisdimethylaminobenzhydryl benzyl ether, N-halophenyl-leucoauramine, N-2,4,5-trichlorophenyl-leucoauramine, etc.

Thiazine-based chromogenic materials, e.g., benzoyl-leucomethyleneblue, p-nitrobenzoyl-leucomethyleneblue, etc.

Spiro-based chromogenic materials, e.g., 3-methyl-spirodinaphthopyran, 3-ethyl-spiro-dinaphthopyran, 3-phenyl-spirodinaphthopyran, 3-benzyl-spiro-dinaphthopyran, 3-methyl-naphtho(6'-methoxybenzo)spiropyran, 3-propyl-spiro-dibenzopyran, etc.

Lactam-based chromogenic materials, e.g., rhodamine-B-anilinolactam, rhodamine-(p-nitroanilino)lactam, rhodamine-(o-chloroanilino)lactam, etc.

Fluoran based chromogenic materials, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chlorethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxyphenylamino)fluoran, 3-(N-ethyl-N-isoamyl-)amino-6-methyl-7-phenylaminofluoran, 3-(N-cyclohexyl-N-methylamino)-6-methyl-7-phenylaminofluoran, 3-(N-ethyl-N-cyclopentyl)amino-6-methyl-7-phenylaminofluoran, 3-pyrolidino-6-methyl-7-phenylaminofluoran, 3-piperidino-6-methyl-7-phenylaminofluoran, 3-diethylamino-6-methyl-7-(2',4'-xylidino)fluoran, 3-(N-ethyl-N-n-butyl)amino-6-methyl-7-(o-toluidino)fluoran, 3-(N-ethyl-N-n-butyl)amino-6-methyl-7-(2',3'-xylidino)fluoran, 3-di-n-propylamino-6-methyl-7-(2',4'-xylidino)fluoran, 3-diethylamino-7-(o-chlorophenylamino)fluoran, 3-dibutylamino-7-(o-chlorophenylamino)fluoran, 3-pyrolidino-6-methyl-7-p-butylphenylaminofluoran, 3-(N-methyl-N-n-amyl-)amino-6-methyl-7-phenylaminofluoran, 3-(N-ethyl-N-n-amyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-$\beta$-ethylhexyl-)amino-6-methyl-7-phenylaminofluoran, etc.

The objective improved heat sensitive recording sheet to be provided according to the present invention may be produced by applying a coating composition, which has been prepared by dispersing fine particles of one or more of the acceptors of the structural formula [I] and fine particles of one or more of the aforesaid chromogenic materials (color formers) in a medium containing a binder in which it is dissolved or dispersed, onto an appropriate support such as paper sheet, plastic film, synthetic paper sheet, woven fabric sheet or mold.

The quantitive proportion of the acceptor versus the color former respectively to be used in the recording layer of the heat sensitive recording sheet to be provided according to this invention is not particularly limited. However, it is common to use 100 to 700 parts by weight of the acceptor versus 100 parts by weight of the color former. And using 150 to 400 parts by weight of the acceptor versus 100 parts by weight of the color former is preferred.

And, when desired, an appropriate amount of one or more of known phenolic acceptors can be used in addition to the aforesaid acceptor.

These materials are formulated into a heat-sensitive coating composition generally with use of water as a dispersion medium and a stirring or pulverizing device, such as a ball mill, attritor or sand mill, by dispersing the two materials at the same time or separately. Usually the coating composition has incorporated therein a binder, such as starches, hydroxyethyl cellulose, methyl cellulose, carboxymethyl cellulose, gelatin, casein, gum arabic, polyvinyl alcohols, styrene-maleic anhydride copolymer salt, styrene-acrylic acid copolymer salt, styrene-butadiene copolymer emulsion or the like. The binder is used in an amount of about 10 to about 40% by weight, preferably about 15 to about 30% by weight, based on the total solids content of the composition.

Various auxiliary agents can be further admixed with the heat sensitive coating composition. Examples of useful auxiliary agents are dispersants such as sodium diocytyl-sulfosuccinate, sodium dodecylbenzenesulfonate, sodium laurylsulfate and fatty acid metallic salts; ultraviolet absorbers of the triazole or like type; defoaming agents; fluorescent dyes; coloring dyes, etc.

Further, other additives can be incorporated into the composition in order to prevent the heat sensitive recording sheet from being stuck in contact with a recording device or recording head of the thermal type facsimile or the printer.

Examples of useful additives are a dispersed liquid or an emulsion of stearic acid, polyethylene, carnauba wax, paraffin wax, zinc stearate, calcium stearate, ester wax and the like.

Further in addition, when desired, heat fusible materials can be incorporated into the composition. Examples of useful heat fusible materials are: fatty acid amides such as stearic acid amide, stearic acid methylenebisamide, oleic acid amide, palmitic acid amide, coconut fatty acid amide, etc.; hindered phenols such as 2,2'-methylene-bis(4-methyl-6-tert-butylphenol), 1,1,3-tris(2-methyl-4-hydroxy-5-tert-butylphenyl)butane, etc.; ethers such as 1,2-bis(phenoxy)ethane, 1,2-bis(4-methylphenoxy)ethane, 1,2-bis(3-methylphenoxy)ethane, 1-phenoxy-2-(4-chlorophenoxy)ethane, 1-phenoxy-2-(4-methoxyphenoxy)ethane, 2-naphtolbenzyl ether, etc.; esters such as dibenzyl terephthalate, 1-hydroxy-2-naphthoic acid phenyl ester, p-benzyloxybenzoic acid benzyl ester, etc.

The axount of the heat fusible material to be used is not particularly limited. However, it is common to use 50 to 500 parts by weight of the heat fusible material versus 100 parts by weight of the acceptor of the structural formula [I]. And using 50 to 200 parts by weight of the thermoplastic material versus 100 parts by weight of the said acceptor.

Still further in addition, when desired, inorganic pigments can be incorporated into the composition in order to prevent piles from the heat sensitive recording sheet to be adhered to the recording head of the thermal type facsimile or the printer.

Examples of useful inorganic pigments are kaolin, clay, talc, calcium carbonate, calcined clay, titanium oxide, kieselguhr, fine granular anhydrous silica, activated clay, etc.

The amount of the composition to be applied onto the surface of a base support to prepare a desirable heat sensitive recording sheet of the present invention generally lies in the range from 2 to 12 g/m$^2$ and preferably 3 to 10 g/m$^2$ respectively on a dry basis.

In the present invention, it is possible to place an appropriate overcoat layer on the heat sensitive recording layer as formed in order to protect the heat sensitive recording layer from being physically damaged. It is also possible to apply an undercoat layer onto the surface of a base support prior to the application of a heat sensitive recording layer thereto. And, an appropriate protective layer can be applied onto the rear surface of a base support, if necessary.

PREFERRED EMBODIMENTS OF THE INVENTION

The advantages of the present invention are now described in more detail by reference to the following Examples and Comparative Examples, which are provided here for illustrative purposes only, and are not intended to limit the scope of the present invention.

Unless otherwise indicated, parts and % signify parts by weight and % by weight respectively.

EXAMPLES OF SYNTHESIS

1. Synthesis of 3,4-dihydroxy-4'-ethyldiphenyl sulfone 40 g of phosphorus pentaoxide was added to 100 ml of methanesulfonic acid while being stirred. Successively 25 ml of ethylbenzene and 47 g of 3,4-dimethoxybenzenesulfonic acid ammonium salt were added, and the resultant mixture was held at 40° C. for 8 hours while the mixture being stirred. After the reaction was completed, the reaction mixture was poured in 1 l ice water. The solid substance consequently precipitated therein was separated by filtration, washed with distilled water and dried under reduced pressure condition to afford 3,4-dimethoxy-4'-ethyldiphenyl sulfone.

After the resultant compound was dissolved in 300 ml of benzene, 100 g of anhydrous aluminum chloride was added and refluxed for an hour. After cooling the reaction mixture to room temperature, it was poured in 1 l of ice water, the solid substance consequently precipitated therein was separated by filtration, washed with distilled water then recrystallized from benzene/acetone to afford 47 g of a crystalline product having a melting point of 147° to 149° C., which was identified to be 3,4-dihydroxy-4'-ethyldiphenyl sulfone (hereinafter referred to as Compound A).

2. Synthesis of other 3,4-dihydroxydiphenyl sulfone derivatives

In accordance with the same manner as Example 1 of Synthesis, there were obtained the following compounds:

Compound B: 3,4-dihydroxy-4'-benzyldiphenyl sulfone (m.p. 148°-151° C.)

Compound C: 3,4-dihydroxy-4'-methylthiodiphenyl sulfone (m.p. 159°-161° C.)

Compound D: 3,4-dihydroxy-4'-phenoxydiphenyl sulfone (m.p. 160°-163° C.)

Compound E: 3,4-dihydroxy-5-methoxy-4'-methyldiphenyl sulfone (m.p. 156°-159° C.)

Compound F: 3,4-dihydroxydiphenyl sulfone (m.p. 152°-153° C.)

Compound G: 3,4-dihydroxy-4'-chlorodiphenyl sulfone (m.p. 155°-159° C.)

Compound H: 3,4-dihydroxy-4'-cyclohexyldiphenyl sulfone (m.p. 174°-176° C.)

Compound I: 3,4-dihydroxy-3',4'-tetramethylenediphenyl sulfone (m.p. 155°-157° C.)

Compound J: 3,4-dihydroxy-2',4'-dimethyldiphenyl sulfone (m.p. 133°-135° C.)

Compound K: 3,4-dihydroxyphenyl 1-naphthyl sulfone (m.p. 161°-164° C.)

Compound L: 3,4-dihydroxy-4-benzyloxydiphenyl sulfone (m.p. 142°-145° C.)

Compound M: 3,4,4'-trihydroxydiphenyl sulfone (m.p. 171°-175° C.)

Compound N: 3,4-dihydroxy-4'-methoxydiphenyl sulfone (m.p. 153°-156° C.)

Compound O: 3,4-dihydroxy-4'-phenylthiodiphenyl sulfone (m.p 177°-179° C.)

EXAMPLES OF PREPARATION OF HEAT SENSITIVE RECORDING SHEETS

EXAMPLE 1

A coating composition for the heat sensitive recording layer was prepared in the following manner.

(1) Preparation of mixture A

| | |
|---|---|
| 3-(N—cyclohexyl-N—methylamino)-6-methyl | 10 parts |

-continued

| | |
|---|---|
| 7-phenylaminofluoran | |
| Stearic acid amide | 20 parts |
| 5% aqueous solution of methyl cellulose | 15 parts |
| Water | 120 parts |

The above mixture was pulverized by a sand mill to a mean particle size of 3 μm.

(2) Preparation of mixture B

| | |
|---|---|
| 3,4-dihydroxy-4'-ethyldiphenyl sulfone (Compound A) | 30 parts |
| 5% aqueous solution of methyl cellulose | 30 parts |
| Water | 70 parts |

The above mixture was pulverized by a sand mill to a mean particle size of 3 μm.

(3) Formation of recording layer 165 parts of the mixture A, 130 parts of the mixture B, 30 parts of silicon oxide pigment (oil absorption: 180 m/1100 g), 150 parts of 20% aqueous solution of oxidized starch and 55 parts of water were mixed together and agitated to obtain a heat sensitive coating composition.

The composition obtained was applied to a non-coated paper sheet weighing 50 g/m$^2$ in an amount of 7.5 g/m$^2$ based on dry weight and dried to obtain a heat sensitive recording paper sheet (hereinafter referred to as "Sheet No. A").

EXAMPLES 2 to 15

The procedures of Example 1 were repeated except that Compounds B to O obtained in Examples of Synthesis were respectively used instead of Compound A in the preparation of the mixture B, to obtain 14 kinds of heat sensitive recording paper sheets (hereinafter, referred to as "Sheet No.B", "Sheet NO.C", "Sheet No.D", "Sheet No.E", "Sheet No.F", "Sheet No.G", "Sheet No.H", "Sheet No.I", "Sheet No.J", "Sheet No.K", "Sheet No.L", "Sheet No.M", "Sheet No.N", and "Sheet No.O", respectively.)

Comparative Example 1

The procedures of Example 1 were repeated except that bisphenol A (hereinafter referred to as Compound P) was used instead of Compound A in the preparation of the mixture B, to obtain a heat sensitive recording paper sheet (hereinafter referred to as "Sheet No.P").

Comparative Example 2

The procedures of Example 1 were repeated except that 4-hydroxy-4'-methyldiphenyl sulfone (hereinafter referred to as "Compound Q") was used instead of Compound A in the preparation of the mixture B, to obtain a heat sensitive recording paper sheet (hereinafter referred to as "Sheet No.Q").

COMPARATIVE EXAMPLE 3

The procedures of Example 1 were repeated except that 2,4-dihydroxy-4'-methyldiphenyl sulfone (hereinafter referred to as "Compound R") was used instead of Compound A in the preparation of the mixture B, to obtain a heat sensitive recording paper sheet (hereinafter referred to as "Sheet No.R").

Tests of Developed Color Densities And Whiteness On The Heat Sensitive Recording Sheets The heat sensitive recording paper sheets thus obtained in Examples 1 to 15 and Comparative Examples 1 to 3, i.e., Sheet Nos. A to R were tested for their developed color densities, continuities of the developed color densities after having been contacted with plastic films containing plasticizers, whitenesses and durabilities of the whitenesses after having been contacted with diazo type copying papers containing diazo developers.

Test of Developed Color Density (hereinafter referred to as "Test (1)")

The above heat sensitive recording sheets were recorded with Thermal Type Facsimile of Hitachi, Ltd. (Trademark Name: HIFAX-700) and the color density (Do) of the images developed on each of the heat sensitive recording sheets were measured by Macbeth Reflection Densitometer of Macbeth Corp., U.S.A. (amber filter being used).

The results are shown in Table 1.

Test of the Continuity of The Developed Color Density (hereinafter referred to as "Test (2)")

Each of the above recorded heat sensitive recording sheets was stored in touch with vinylchloride films for an hour and the color density ($D_1$) of the once developed images was measured by the aforesaid Macbeth Reflection Densitometer.

The results are shown in Table 1.

Test of Whiteness of Heat Sensitive Recording Sheet (hereinafter referred to as "Test (3)")

The above non-recorded heat sensitive recording sheets were subjected to the measurement of the whitenesses of their recording layer surfaces by Hunter Multipurpose Reflectometer of TOYOSEIKI-SEISAKUJO, a company of Japan.

The results are shown in Table 1.

Test of Whiteness of Heat Sensitive Recording Sheet After Having Been Touched With A Diazo Type Copying Paper (hereinafter referred to as "Test (4)")

After the above non-recorded heat sensitive recording sheets were stored in touch with diazo type copying papers containing diazo developers of Ricoh Co., Ltd., Japan (Trademark Name: SD Type) for five minutes, they were subjected to the measurement of the whiteness of their recording layer surfaces by the aforesaid Hunter Multipurpose Reflectometer.

The results are shown in Table 1.

TABLE 1

| | Acceptor | Test (1) ($D_0$) | Test (2) ($D_1$) | Test (3) (%) | Test (4) (%) |
|---|---|---|---|---|---|
| Number of Example | | | | | |
| 1 | Compound A | 1.30 | 1.27 | 82.9 | 80.4 |
| 2 | Compound B | 1.34 | 1.29 | 82.7 | 80.6 |
| 3 | Compound C | 1.32 | 1.27 | 82.4 | 80.3 |
| 4 | Compound D | 1.28 | 1.24 | 83.0 | 81.2 |
| 5 | Compound E | 1.33 | 1.29 | 82.3 | 80.1 |
| 6 | Compound F | 1.31 | 1.20 | 82.2 | 80.1 |
| 7 | Compound G | 1.30 | 1.21 | 83.1 | 81.8 |
| 8 | Compound H | 1.29 | 1.22 | 83.5 | 82.2 |
| 9 | Compound I | 1.33 | 1.27 | 83.0 | 81.9 |
| 10 | Compound J | 1.31 | 1.25 | 83.0 | 81.7 |
| 11 | Compound K | 1.33 | 1.29 | 83.2 | 82.0 |
| 12 | Compound L | 1.30 | 1.26 | 82.8 | 81.9 |
| 13 | Compound M | 1.34 | 1.28 | 82.5 | 80.2 |
| 14 | Compound N | 1.32 | 1.26 | 82.9 | 81.7 |
| 15 | Compound O | 1.30 | 1.26 | 83.1 | 82.2 |
| Number of Comparative Example | | | | | |
| 1 | Compound P | 0.80 | 0.21 | 80.4 | 52.1 |
| 2 | Compound Q | 1.14 | 0.73 | 81.0 | 66.4 |

TABLE 1-continued

| | Acceptor | Test (1) ($D_0$) | Test (2) ($D_1$) | Test (3) (%) | Test (4) (%) |
|---|---|---|---|---|---|
| 3 | Compound R | 1.23 | 0.98 | 81.4 | 74.5 |

From the results as shown in Table 1, it has been confirmed that the heat sensitive recording sheets according to the present invention have a wealth of not only high speed recording characteristics but also extremely improved resistances against plasticizers and against diazo developers.

What we claim is:

1. In a heat sensitive recording sheet which comprises a base support and a heat sensitive recording layer formed over the base support and which contains a colorless or pale colored basis chromogenic material and an electron accepting color developing material capable of forming a color when contacted with the chromogenic material, the recording layer contains as the color developing material at least a compound selected from the group consisting of 3,4-dihydroxydiphenyl sulfone derivatives being represented by the structural formula:

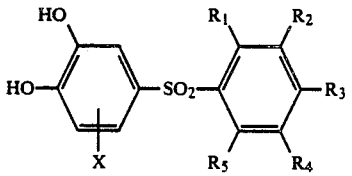

[I]

wherein X is hydrogen atom, halogen atom, alkyl group or alkoxy group, and $R_1$, $R_2$, $R_3$, $R_4$ and $R_5$ are respectively hydrogen atom, halogen atom, hydroxyl group, alkyl group, cycloalkyl group, aralkyl group, aryl group, alkoxy group, aralkyloxy group, aryloxy group, alkylthio group, aralkylthio group or arylthio group, or, both $R_1$ and $R_2$ or both $R_2$ and $R_3$ may form a naphthalene ring, a tetrahydronaphthalene ring or an indane ring together with their adjacent benzene ring.

2. A heat sensitive recording sheet as defined in claim 1 which contains at least a compound of the 3,4-dihydroxydiphenyl sulfone derivatives of the structural formula [I] wherein X is hydrogen atom, chlorine atom, bromine atom, alkyl group of 1 to 5 carbon atoms or alkoxy group of 1 to 5 carbon atoms, and $R_1$, $R_2$, $R_3$, $R_4$ and $R_5$ are respectively hydrogen atom, chlorine atom, bromine atom, hydroxyl group, alkyl group of 1 to 5 carbon atoms, cyclohexyl group, benzyl group, phenetyl group, phenyl group, alkoxy group of 1 to 5 carbon atoms, benzyloxy group, phenoxy group, alkylthio group of 1 to 5 carbon atoms, benzylthio group or phenylthio group, or, both $R_1$ and $R_2$ or both $R_2$ and $R_3$ may form a naphthalene ring, a tetrahydronaphthalene ring or an indane ring together with their adjacent benzene ring.

3. A heat sensitive recording sheet as defined in claim 2, wherein at least one of the 3,4-dihydroxydiphenyl sulfone derivatives to be contained in the heat sensitive recording sheet is 3,4-dihydroxy-4'-ethyldiphenyl sulfone, 3,4-dihydroxy-4'-benzyldiphenyl sulfone, 3,4-dihydroxy-4'-methylthiodiphenyl sulfone, 3,4-dihydroxy-4'-phenoxydiphenyl sulfone, 3,4-dihydroxy-5-methoxy-4'-methyldiphenyl sulfone, 3,4-dihydroxydiphenyl sulfone, 3,4-dihydroxy-4'-chlorodiphenyl sulfone, 3,4-dihydroxy-4'-cyclohexyldiphenyl sulfone, 3,4-dihydroxy-3',4'-tetramethylenediphenyl sulfone, 3,4-dihydroxy-2',4'-dimethyldiphenyl sulfone, 3,4-dihydroxyphenyl-1-naphthyl sulfone, 3,4-dihydroxy-4-benzyloxydiphenyl sulfone, 3,4,4'-trihydroxydiphenyl sulfone, 3,4-dihydroxy-4'-methoxydiphenyl sulfone or 3,4-dihydroxy-4'-phenylthiodiphenyl sulfone.

* * * * *